United States Patent [19]

Armand et al.

[11] 4,443,306

[45] Apr. 17, 1984

[54] PROCESS AND CELL FOR THE PREPARATION OF POLYVALENT METALS SUCH AS ZR OR HF BY ELECTROLYSIS OF MOLTEN HALIDES

[75] Inventors: Marcel Armand, Meylan; Philippe Moinard, Saint Martin d'Heres, both of France

[73] Assignee: Pechiney Ugine Kuhlmann, Paris, France

[21] Appl. No.: 321,624

[22] Filed: Nov. 16, 1981

[30] Foreign Application Priority Data

Nov. 27, 1980 [FR] France ..... 80 25507

[51] Int. Cl.[3] ..... C25C 3/26

[52] U.S. Cl. ..... 204/64 T; 204/252

[58] Field of Search ..... 204/64 T, 247, 252

[56] References Cited

U.S. PATENT DOCUMENTS

| | | | |
|---|---|---|---|
| 2,760,930 | 8/1956 | Alpert et al. | 204/64 T |
| 2,789,943 | 4/1957 | Kittelberger | 204/247 |
| 3,345,278 | 10/1967 | Mekjean | 204/147 |
| 4,113,584 | 9/1978 | Johnson | 204/64 T |
| 4,116,801 | 9/1978 | Jucknies et al. | 204/64 T |

*Primary Examiner*—Howard S. Williams

*Attorney, Agent, or Firm*—Dennison, Meserole, Pollack & Scheiner

[57] ABSTRACT

The electrolysis cell according to the invention is concerned with the preparation of Zr or Hf by electrolysis, from a molten mixture of alkali metal or alkaline earth chlorides and fluorides.

It comprises a graphite collector which defines the anodic space and which is extended at the lower end below the level of the electrolyte by a metal wall made of metal to be deposited or coated with said metal.

The wall may advantageously be made in the form of a porous diaphragm.

8 Claims, 4 Drawing Figures

PROCESS AND CELL FOR THE PREPARATION OF POLYVALENT METALS SUCH AS ZR OR HF BY ELECTROLYSIS OF MOLTEN HALIDES

The novel electrolysis cell which is the subject of the present invention is concerned with the preparation of Zr or Hf by electrolysis.

More particularly, it is concerned with the preparation of Zr or Hf by the electrolysis of molten mixtures of alkali metal or alkaline earth chlorides and fluorides, in which Zr or Hf occur in solution in the form of complexes. Tests have shown that the presence of fluorides in such molten mixtures has the essential effect of permitting dissolution of several percent by weight of Zr or Hf from $ZrCl_4$ or $HfCl_4$. It appears that the presence of fluorides also makes it possible to stabilise the valency 4 of the zirconium and hafnium in those electrolytes.

Different types of electrolysis cells have been proposed, to permit the preparation of Zr from such electrolytes.

The features of the electrolysis cells which have been proposed and those of the cell forming the subject-matter of this invention, will be more clearly appreciated from the following drawings.

FIG. 1 shows an electrolysis cell for the preparation of zirconium, which is described in report RI8125 by USBM: 'Investigation of a cell design for electrowinning zirconium metal from zirconium tetrachloride', G M Martinez et al, (1976).

Figure 1:
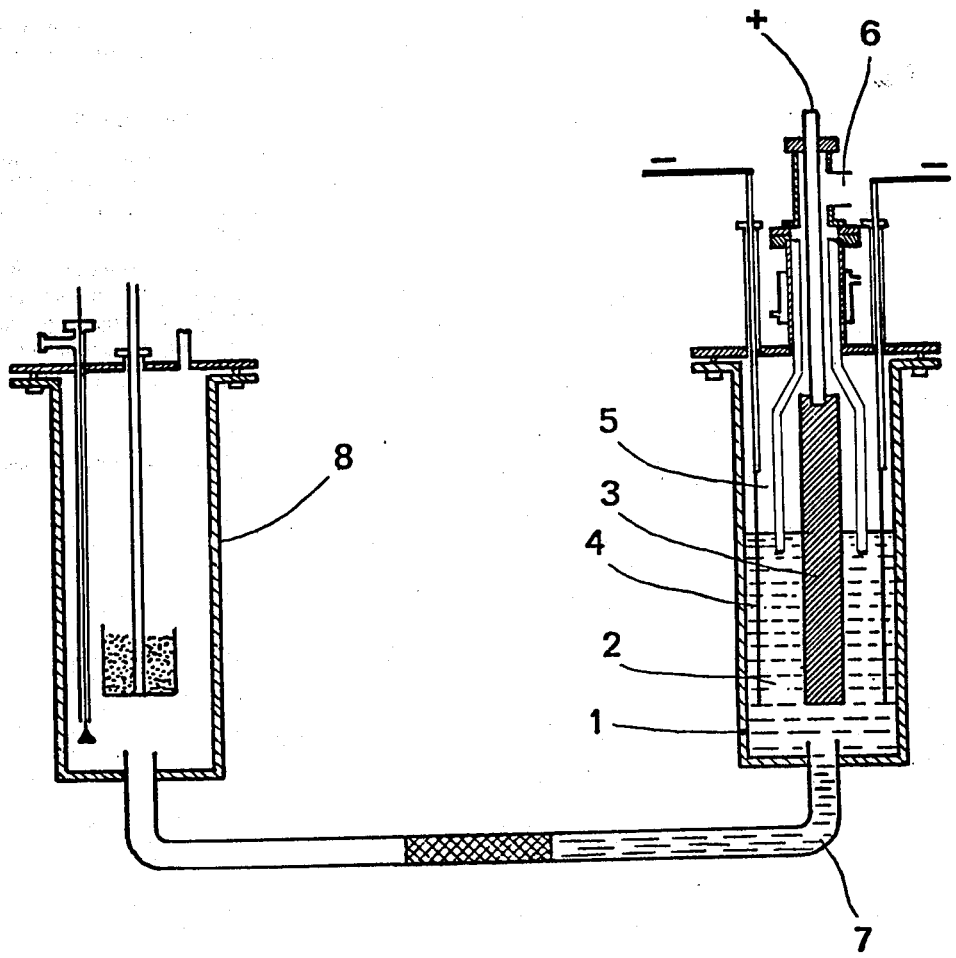
FIG. 1 shows an electrolysis cell in accordance with the USBM RI8125 report.

In the configuration shown on the right in FIG. 1, the cell 1 which is of stainless steel, type 316, is filled with an electrolyte 2 which initially contains the following, in percent by weight:

90.9 NaCl 9.1 NaF and 2.0 Zr (related to NaCl+NaF) in the form $ZrCl_4$.

A graphite anode 3 is connected to the positive terminal of a current source (not shown) and an annular nickel cathode 4 surrounds the anode and is connected to the negative terminal of the current source. Between the two, a graphite collector 5 collects the chlorine which is given off at the anode and directs it towards the gas discharge duct 6. The lower part of the collector penetrates a little below the surface of the electrolyte, so as to form a hydraulic seal means. Finally, a duct 7 connecting to a container 8 shown on the left in FIG. 1, which is also of stainless steel type 316, permits the cell to be emptied, by transferring the electrolyte into the container 8. Such an operation is carried out for example after the electrolytic deposit on the cathode 4 of the zirconium which is initially contained in the electrolyte, in order to recover it.

The electrolysis tests carried out by Martinez et al have shown that it is possible to carry out electrolysis with a fairly good overall level of ampere efficiency. However, it has been found that, in spite of the hydraulic seal at the collector, small amounts of chlorine pass into the cathodic compartment and attack the walls of the cell. This phenomenon is attributed to the fact that the lower part of the graphite collector, which is immersed in the electrolyte, acts as a bipolar electrode. This means that it operates as a cathode on the face which is towards the axial anode, with chlorine being redissolved in ionic form; on the face which is towards the cathode, it operates in contrast as an anode, with a little chlorine being given off in the cathodic compartment. That chlorine causes corrosion of the walls of the cell.

Figure 2:
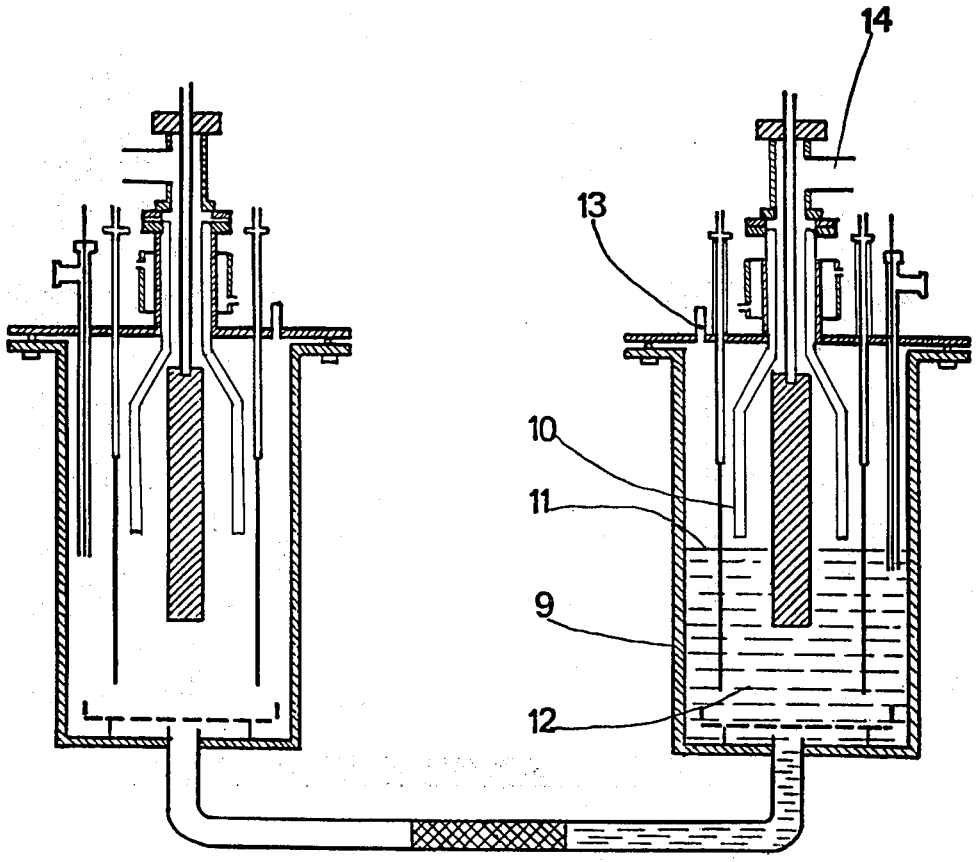
FIG. 2 shows an electrolysis cell modified in accordance with the USBM RI8125 report.

In order to overcome those disadvantages, the same report proposes that a hydraulic seal should no longer be made between the collector and the electrolyte but on the contrary a small annular space should be left between the collector and electrolyte. FIG. 2 shows an assembly of two identical cells, which is proposed in accordance with that report. It will be seen from the right-hand cell 9 that the bottom of the collector 10 does not come into contact with the surface 11 of the electrolyte 12. In order to prevent the chlorine from passing into the cathodic compartment, helium is introduced into the cell through the cover by way of the tube 13 which opens into the cathodic region. The flow of helium diffuses below the collector and passes through the anodic region, entraining the chlorine which is given off along the anode. The gas mixture issues from the cell by way of the tube 14 which is connected to a collecting system (not shown).

Although such an arrangement makes it possible to avoid the collector operating as a bipolar electrode, it does not enable the problem which arises to be entirely overcome.

In fact, efficient scavenging requires a relatively high speed of flow of inert gas through the passage between the collector and the surface of the electrolyte.

This means that, in regard to an industrial cell, high inert gas flow rates would be required. That gas would dilute the chlorine to a substantial degree, and the costs of separation and recycling would be high. Finally, the gas flow would give rise to the danger of interferring with the thermal equilibrium of the cell, and pre-heating would probably be necessary.

Attempts which have been made in the past to use collectors of refractory oxides such as alumina or zirconia have given poor results, as such oxides were attacked by the electrolyte and the metal produced at the cathode was contaminated by oxygen and by the metal of the oxide.

The novel electrolysis cell which is the subject of the present invention enables these difficulties to be overcome. It comprises, above the electrolyte, an anodic space defined by a collector which is of graphite or which is coated with graphite and the lower end of which penetrates a little below the surface of the electrolyte to form a hydraulic seal. The lower end is extended into the electrolyte by a metal wall which is solid or perforated or porous, which is made of metal to be deposited or coated with the metal to be deposited.

The above-mentioned wall may advantageously be in the form of a diaphragm and a fraction of the anodic current may advantageously be deflected through the diaphragm. The strength of the deflected current may be dependent on a reference potential difference.

Figure 3:
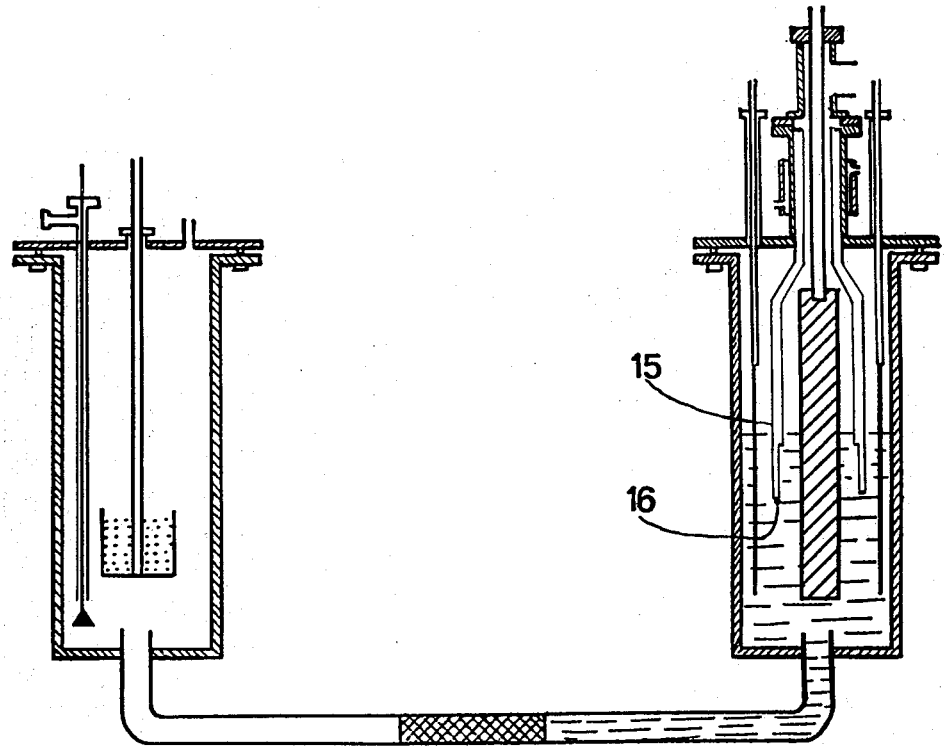
FIG. 3 shows the electrolysis cell according to the invention.

A first embodiment according to the invention, as shown in FIG. 3, involves disposing in a cell similar to that described in FIG. 1, a collector 15 of graphite or metal which cannot be attacked by the electrolyte and which is covered with graphite on the anodic side. The graphite covering can be formed for example by means of an expanded graphite-base felt. The end of the collector engages into the electrolyte only to a shallow depth; it is extended in the electrolyte by an annular wall 16 of polyvalent metal to be deposited (zirconium or hafnium). The wall 16 which is of limited height may or may not be perforated. It may be produced for example by means of a perforated or unperforated metal plate, a shaped member, or expanded metal sheet. Under these conditions, the chlorine ions produced in the electrolyte by dissolution of the anodic chlorine in contact with the collector will dissolve the polyvalent metal of the wall, in the chloride form, thus avoiding any gaseous chlorine being given off on the cathodic face of the collector, and the polyvalent metal wall which acts as a sacrificial anode merely has to be replaced periodically.

Such an arrangement which eliminates the production of chlorine on the cathodic side makes it possible to avoid any corrosion phenomenon in that region of the cell, and also makes it possible very substantially to increase the levels of ampere efficiency, both as regards the chlorine yield and the yield in respect of Zr or Hf. In addition, using solely metal materials and graphite in the cell makes it possible to produce deposits of Zr or Hf in a high state of purity, and the oxygen contents of which are at a particularly low level.

A second embodiment which is also in accordance with the invention but which is even more advantageous provides that the polyvalent metal wall is made in the form of a diaphragm of suitable porosity, which entirely surrounds the anode, being made of a metal that cannot be attacked by the electrolyte, such as nickel, cobalt or stainless steels.

In the course of the electrolysis operation which is carried out with a current I between the anode and the cathode, the diaphragm is maintained in a slightly cathodic condition with respect to the anode, by diverting a current $I_1$, which is a fraction of the current I, through the diaphragm. Under the action of that current, the diaphragm is covered with the polyvalent metal and, provided that the current $I_1$ is sufficient, it is this constantly renewed deposit which serves as a sacrificial anode.

The strength of the current $I_1$ can be maintained at its optimum value by virtue of the properties of such a diaphragm, covered with the metal to be deposited. In fact, for example in the case of electrolysis of zirconium, the diaphragm behaves, relative to the electrolyte, as an electrode of zirconium, in a condition of potential equilibrium with respect to the electrolyte. On the cathodic side, that potential is defined by the following formula:

$$e_o^{Zr^{4+}/Zr^o} + \frac{RT}{4F} \ln a^{Zr^{4+}} \text{ cathodic} \quad (1)$$

In the above formula, '$e_o^{Zr^{4+}/Zr^o}$, represents the normal potential of the zirconium electrode: '$Zr^o \rightarrow Zr^{4+} + 4e$', '$a^{Zr^{4+}}$ cathodic' representing the activity of the ions $Zr^{4+}$ in the catolyte. On the anodic side, the potential of the diaphragm with respect to the electrolyte is defined by the following formula:

$$e_o^{Zr^{4+}/Zr^o} + \frac{RT}{4F} \ln a^{Zr^{4+}} \text{ anodic} \quad (2)$$

In the above formula, the conventions used are the same as in the previous formula, and '$a^{Zr^{4+}}$ anodic' represents the activity of the ions $Zr^{4+}$ in the anolyte. On starting the electrolysis operation with a current I and a corresponding $ZrCl_4$ feed, because of the high level of electron conductivity of the material forming the diaphragm, the diaphragm initially operates like a bipolar electrode. The result of this is as follows:

on its anodic face, a deposit of zirconium, at the expense of the ions $Zr^{4+}$ of the anolyte: '$a^{Zr^{4+}}$ anodic falls;

on its cathodic face, equivalent dissolution of metal zirconium, at the expense of the metal deposited by the current $I_1$, however, the volume of the catholyte being large, with respect to that of the anolyte, '$a^{Zr^{4+}}$ cathodic' is only slightly altered.

A potential difference appears in the electrolyte between the two faces of the diaphragm and an ion current through the electrolyte impregnating the diaphragm tends progressively to replace the initial electron current and, in steady-state operation, a condition of stable equilibrium is finally attained:

$$e_o^{Zr^{4+}/Zr^o} + \frac{RT}{4F} \ln a^{Zr^{4+}} \text{ cathodic-}IR_D = e_o^{Zr^{4+}/Zr^o} + \frac{RT}{4F} \ln a^{Zr^{4+}} \text{ anodic}$$

in which $R_D$ represents the resistance of the electrolyte impregnating the diaphragm.

The above-mentioned resistance $R_D$ depends not only on the initial porosity of the diaphragm but also the amount of zirconium deposited, which is itself the result of the strength of the current $I_1$ which tends to increase it, and the corrosion current which tends to reduce it. Therefore, in order to nullify the effects of the latter, it is sufficient to adjust $I_1$ in such a way that $R_D$ remains constant, that is to say, for a constant strength of I, $I_1$ only has to be controlled in dependence on the variations in $IR_D$, in order for the latter to be maintained constant.

Figure 4:
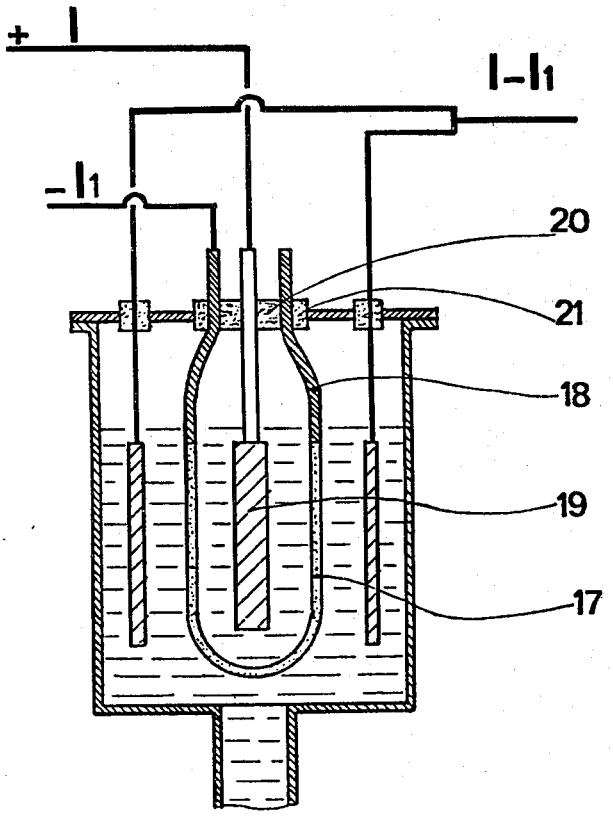
FIG. 4 shows the electrolysis cell according to the invention with a regulating device.

FIG. 4 is a diagrammatic view similar to that of the right-hand part of FIG. 3, showing a zirconium electrolysis cell operating in accordance with the second improved alternative. For that purpose, as shown in the drawing, the diaphragm 17 which comprises nickel gauze is connected by way of the collector 18 which is also of nickel and which is coated on its face which is towards the anode with an expanded graphite felt, to the negative terminal of a current source (not shown), the positive terminal of which is connected to the anode 19. The collector is insulated from the anode 19 and the cover of the cell by the insulating through-way means 20 and 21. In this way, a current of strength $I_1$ which is a fraction of the electrolysis current of strength I which passes through the anolyte, can be diverted into the diaphragm. By virtue of the current $I_1$, metal zirconium is deposited on the diaphragm and can thus compensate for that which is dissolved by the corrosion current resulting from the redissolution of the chlorine in ionic form on contact with the anodic face of the collector.

It is important to be able to adjust $I_1$ in dependence on the corrosion current. For that purpose, the potential drop $IR_D$ across the diaphragm or a voltage which is dependent on that potential drop is compared to a reference voltage. When $IR_D$ or the voltage which is dependent on $IR_D$ falls below the reference voltage, the strength of the current $I_1$ in the diaphragm is increased in proportion to an increasing difference between $IR_D$ or the voltage which is dependent on $IR_D$, and the reference voltage. The strength of the current which passes through the catolyte is of course $I-I_1$.

An approximate measurement of $IR_D$ can be made by measuring the potential difference between two reference electrodes such as electrodes which are sensitive to chlorine ions, and which are disposed on respective sides of the diaphragm without being in contact therewith. As a simpler and easier arrangement, it may also be sufficient to measure the potential difference between the diaphragm and the anode, which depends only on $IR_D$ and constant characteristics of the cell.

The porosity of the diaphragm is not a critical factor. The only necessity is that the porosity of the diaphragm should be sufficient so as not to interfere with equalisation of pressures between the cathodic and anodic compartments, while however being of a sufficiently low level to give rise to an easily measurable potential drop.

Such a device has the advantage over the previous device of not requiring any action on the cell to replace the sacrificial wall which in this case is self-regenerating.

We claim:

1. A process to electrolytically produce zirconium or hafnium from chlorides thereof in a bath of molten alkali metal or alkaline earth halides in an electrolytic cell consisting of:

(a) providing above the electrolyte an anodic space defined by a graphite collector;

(b) extending the lower end of the collector below the surface of the electrolyte to form a seal wherein the lower end of the collector is extended by an annular porous wall or diaphragm of polyvalent metal;

(c) directing a negative current to said collector such that the electrical resistance of the electrolyte impregnating the collector is maintained at a constant value; and (d) maintaining the value of the electrical resistance of the electrolyte by adjusting the strength of the current directed to the collector as a function of the difference between the potential difference through the electrolyte and a reference potential.

2. A process according to claim 1, wherein the annular wall of polyvalent metal is zirconium or hafnium.

3. A process according to claim 1, wherein the annular wall of polyvalent metal is a diaphragm of metal that cannot be attacked by the electrolyte and is coated with the metal to be deposited.

4. A process according to claim 1, wherein the annular wall is connected by way of the collector to the negative terminal of a current source, the positive terminal of which is connected to the anode of the cell.

5. A process according to claim 1, wherein two reference electrodes are disposed on respective sides of said wall and are connected to a means for measuring their potential difference.

6. A process according to claim 1, wherein the value of the electrical resistance of the electrolyte is expressed by the following equation:

$$e_o^{Zr4+/Zro} + \frac{RT}{4F} \ln a^{Zr4+} \text{ cathodic-}IR_D = e_o^{Zr4+/Zro} + \frac{RT}{4F} \ln a^{Zr4+} \text{ anodic}$$

in which $R_D$ represents the resistance of the electrolyte impregnating the diaphragm.

7. A cell according to claim 1, which includes means for maintaining the electrical resistance of the electrolyte which impregnates the diaphragm at a constant value by diverting into the diaphragm a current, the strength of which is dependent on the difference between the potential difference through the electrolyte and a reference potential difference.

8. A novel cell for the preparation of Zr or Hf by electrolysis of chlorides thereof in a bath of molten alkali metal and/or alkaline earth halides, which comprises a collector which defines an anodic space above the electrolyte, said collector comprising graphite or coated with graphite, the lower end of which collector penetrates a little below the surface of the electrolyte to form a hydraulic seal and is extended by a porous metal wall, which metal wall is a diaphragm made of a metal that cannot be attacked by the electrolyte and which is coated, prior to electrolysis, with the metal to be deposited during electrolysis, and which cell further comprises two reference electrodes disposed on opposite sides of the diaphragm and which are connected to a means for measuring their potential difference.

* * * * *